US008256728B2

(12) United States Patent
Wright

(10) Patent No.: US 8,256,728 B2
(45) Date of Patent: Sep. 4, 2012

(54) SPEAKER ASSEMBLIES, METHODS OF INSTALLING SPEAKER ASSEMBLIES AND METHODS OF MAKING SPEAKER ASSEMBLIES

(76) Inventor: Doug S. Wright, Couer d'Alene, ID (US)

( * ) Notice: Subject to any disclaimer, the term of this patent is extended or adjusted under 35 U.S.C. 154(b) by 252 days.

(21) Appl. No.: 12/755,405

(22) Filed: Apr. 6, 2010

(65) Prior Publication Data

US 2010/0252703 A1 Oct. 7, 2010

Related U.S. Application Data

(60) Provisional application No. 61/166,927, filed on Apr. 6, 2009.

(51) Int. Cl.
*A47B 96/00* (2006.01)

(52) U.S. Cl. ..... 248/221.11; 248/222.51; 248/222.52; 248/27.3; 181/150; 362/365; 381/386; 381/87

(58) Field of Classification Search ..... 248/221.11, 248/222.51, 222.52, 292.12, 183.4, 422, 248/222.13, 27.3; 181/199, 150; 381/386, 381/395, 87, 97; 362/365, 370
See application file for complete search history.

(56) References Cited

U.S. PATENT DOCUMENTS 5,077,650 A * 12/1991 Cestari ..... 362/365
5,285,360 A * 2/1994 Kanner ..... 362/524
5,331,119 A * 7/1994 Leger et al. ..... 181/150
5,351,170 A * 9/1994 Nagengast et al. ..... 362/463
5,964,523 A * 10/1999 Eversberg ..... 362/365
6,007,028 A * 12/1999 Lin ..... 248/27.3
6,132,069 A * 10/2000 Sato et al. ..... 362/365
6,241,368 B1 * 6/2001 Depino ..... 362/364
6,471,374 B1 * 10/2002 Thomas et al. ..... 362/285
6,588,543 B1 * 7/2003 Tchilinguirian ..... 181/150
6,717,050 B2 * 4/2004 Laflamme et al. ..... 174/50
7,172,160 B2 * 2/2007 Piel et al. ..... 248/27.1
7,281,697 B2 * 10/2007 Reggiani ..... 248/323
7,300,025 B2 * 11/2007 Korcz ..... 248/56
7,334,767 B2 * 2/2008 Wright ..... 248/342
7,475,920 B2 * 1/2009 Bigazzi et al. ..... 292/201
7,483,544 B2 * 1/2009 Wright et al. ..... 381/336
7,530,717 B2 * 5/2009 Magisano et al. ..... 362/365
7,570,778 B2 * 8/2009 Wright ..... 381/387
7,587,059 B2 * 9/2009 Wright ..... 381/387
7,588,354 B1 * 9/2009 Hu et al. ..... 362/365
7,676,045 B2 * 3/2010 Merrey et al. ..... 381/87
7,731,130 B2 * 6/2010 Decanio et al. ..... 248/27.3
7,762,039 B2 * 7/2010 Hickey ..... 52/741.1
7,780,135 B2 * 8/2010 Nelson et al. ..... 248/342
7,854,537 B2 * 12/2010 Caluori ..... 362/404

(Continued)

*Primary Examiner* — Terrell McKinnon
*Assistant Examiner* — Daniel J Breslin
(74) *Attorney, Agent, or Firm* — Julio M. Loza; Loza & Loza, LLP

(57) ABSTRACT

Speaker assemblies are disclosed that are configured for simple installation and removal. Speaker assemblies include a gear ring, a plurality of screws adapted to rotate when the gear ring is rotated, and a latching mechanism adapted to extend one or more latches outward when the screws are rotated. Methods of installing speaker assemblies include inserting a frame through a mounting hole in a mounting panel. A gear ring coupled to a plurality of screws is rotated, and a plurality of latches extend outward to engage a back-side surface of the mounting panel. Methods of making speaker assemblies include coupling a plurality of screws with a gear ring to enable rotation of the plurality of screws upon rotation of the gear ring. A latching mechanism is coupled to each of the plurality of screws.

13 Claims, 12 Drawing Sheets

U.S. PATENT DOCUMENTS 7,938,851 B2 * 5/2011 Olson et al. ..... 623/1.11
8,023,664 B2 * 9/2011 Yang ..... 381/87
8,103,034 B2 * 1/2012 Tai ..... 381/332
8,148,634 B1 * 4/2012 Gretz ..... 174/50
2005/0072891 A1 * 4/2005 Wright ..... 248/342
2007/0121988 A1 * 5/2007 Merrey et al. ..... 381/386
2009/0324004 A1 * 12/2009 Yang ..... 381/395
2010/0040254 A1 * 2/2010 Wright ..... 381/395

* cited by examiner

SPEAKER ASSEMBLIES, METHODS OF INSTALLING SPEAKER ASSEMBLIES AND METHODS OF MAKING SPEAKER ASSEMBLIES

CLAIM OF PRIORITY UNDER 35 U.S.C. §119

The present Application for Patent claims priority to Provisional Application No. 61/166,927 entitled "Tool-Less, Multi-Point Capture, Non-Indexing Instant Latch System for Audio Devices" filed Apr. 6, 2009, the entire disclosure of which is hereby expressly incorporated by reference herein.

FIELD

Various embodiments of the invention pertain to speaker mountings and assemblies that allow relatively simplified installation.

BACKGROUND

In order to save space, and/or for aesthetic reasons, it is often desirable to mount speakers within wall or ceiling cavities or recesses. However, such recessed speakers are often difficult to install and conventionally require one or more tools to install. Thus, it is desirable that recessed speakers be simple to install without the need of tools.

SUMMARY

Various embodiments of the present disclosure are directed to speaker assemblies configured to be easily installed within a mounting panel cavity. Such speaker assemblies may comprise a gear ring, a plurality of screws adapted to rotate when the gear ring is rotated, and a latching mechanism. The latching mechanism may be adapted to extend one or more latches outward as the screws are rotated.

Additional embodiments of the present disclosure include methods of installing speaker assemblies. One or more embodiments of such methods may comprise inserting a frame through a mounting hole in a mounting panel. A gear ring coupled to a plurality of screws may be rotated. The plurality of screws are adapted to rotate when the gear ring is rotated. A plurality of latches may extend outward to engage a back-side surface of the mounting panel when the plurality of screws rotate.

Further embodiments of the present disclosure are directed to methods of making a speaker assembly. At least some embodiments of such methods include coupling a plurality of screws with a gear ring to enable rotation of the plurality of screws when the gear ring rotates. A latching mechanism may be coupled to each of the plurality of screws. Each latching mechanism may be configured to displace along a rotational axis of the respective screw when the plurality of screws are rotated.

DETAILED DESCRIPTION

The illustrations presented herein are, in some instances, not actual views of any particular speaker housing, system, or assembly, but are merely idealized representations which are employed to describe the present disclosure. Additionally, elements common between figures may retain the same numerical designation.

Figure 1:
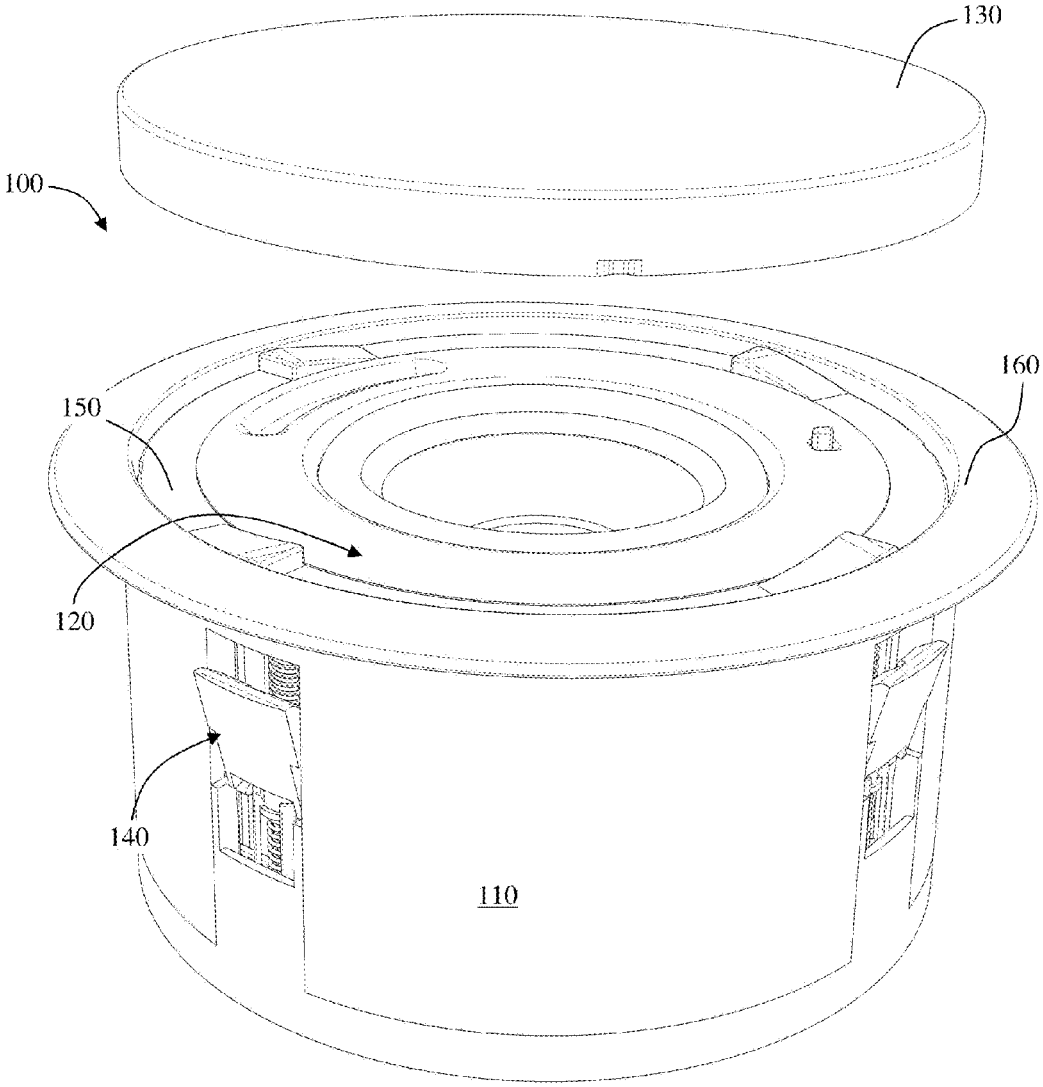
FIG. 1 illustrates an isometric view of a speaker assembly according to at least one embodiment of the present disclosure.

Various embodiments of the present disclosure comprise speaker assemblies adapted to be easily installed into a recess. FIG. 1 illustrates an isometric view of a speaker assembly 100 according to at least one embodiment of the present disclosure. The speaker assembly 100 includes a frame 110, an audio transducer 120 (e.g., a speaker) disposed inside and coupled to the frame 110, a grille 130 disposed over the audio transducer 120, at least one latching mechanism 140, and a gear ring 150.

The frame 110 is configured to be installed within a cavity so that a rim 160 rests against an exterior surface of the cavity while the remaining portions of the frame 110 extend into the cavity. The rim 160 comprises a conventional flange disposed at one end of the frame 110. The frame 110 is substantially free from screws or dogs employed to actuate the clamping/retaining mechanism (latching mechanism 140).

Figure 2:
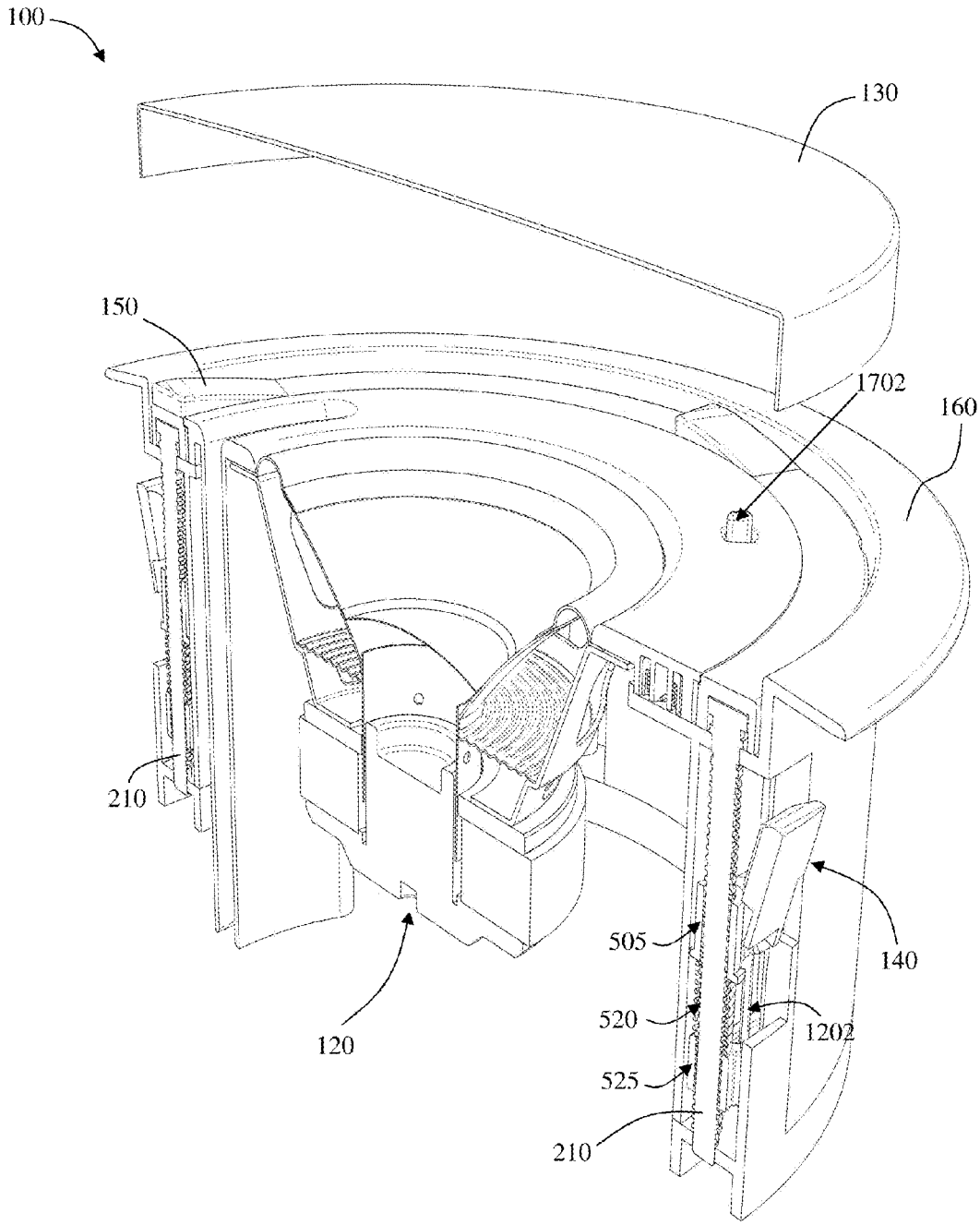
FIG. 2 illustrates a cross-sectioned isometric view of the speaker assembly of FIG. 1.

FIG. 2 illustrates a cross-sectioned isometric view of the speaker assembly 100 of FIG. 1. As shown in FIG. 2, the speaker assembly 100 further includes a plurality of screws 210 (see also FIG. 14) matingly coupled to the gear ring 150 and to a portion of the latching mechanism 140. Each of the screws 210 is adapted to rotate when the gear ring 150 is rotated. More particularly, with reference to FIG. 3, each screw 210 includes a screw gear portion 310 at a first end and threads 320 (e.g., double threads) along a length of screw 210. The screw gear portion 310 is adapted to mate to or engage with a ring gear portion 330 of the gear ring 150. Accordingly, as the gear ring 150 is rotated about its central axis, the teeth of the ring gear portion 330 engage the teeth of the screw gear portion 310 causing each screw 210 to rotate with the rotation of the gear ring 150. Accordingly, the rotation of one or more screws 210 can be simultaneously controlled by the rotation of a single gear ring 150.

Figure 3:
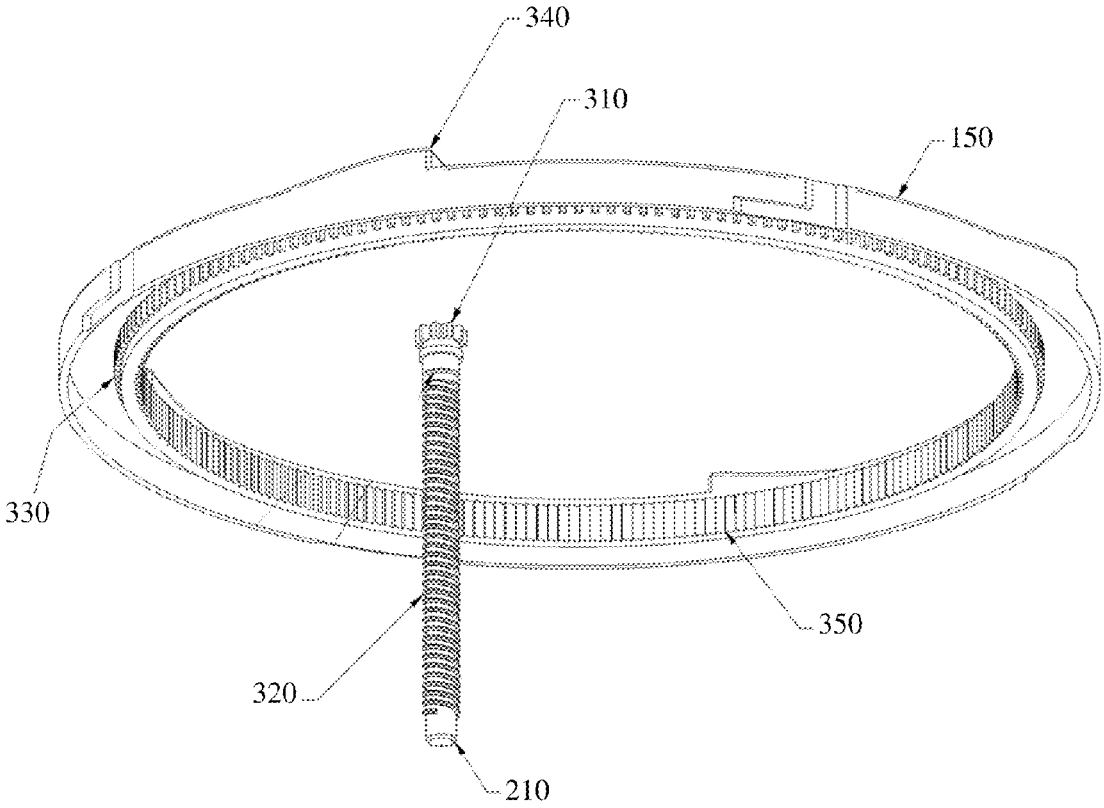
FIG. 3 is an isometric view of a gear ring and a screw according to at least one embodiment of the disclosure.

Referring still to FIG. 3, the gear ring 150 may further include one or more actuation features 340 (e.g., ramps or manual rotation points) for enabling a user to manually rotate the gear ring 150. As shown, the actuation features 340 comprise an extension forming a surface upon which a user may push with one or more fingers to rotate the gear ring 150.

Figure 4:
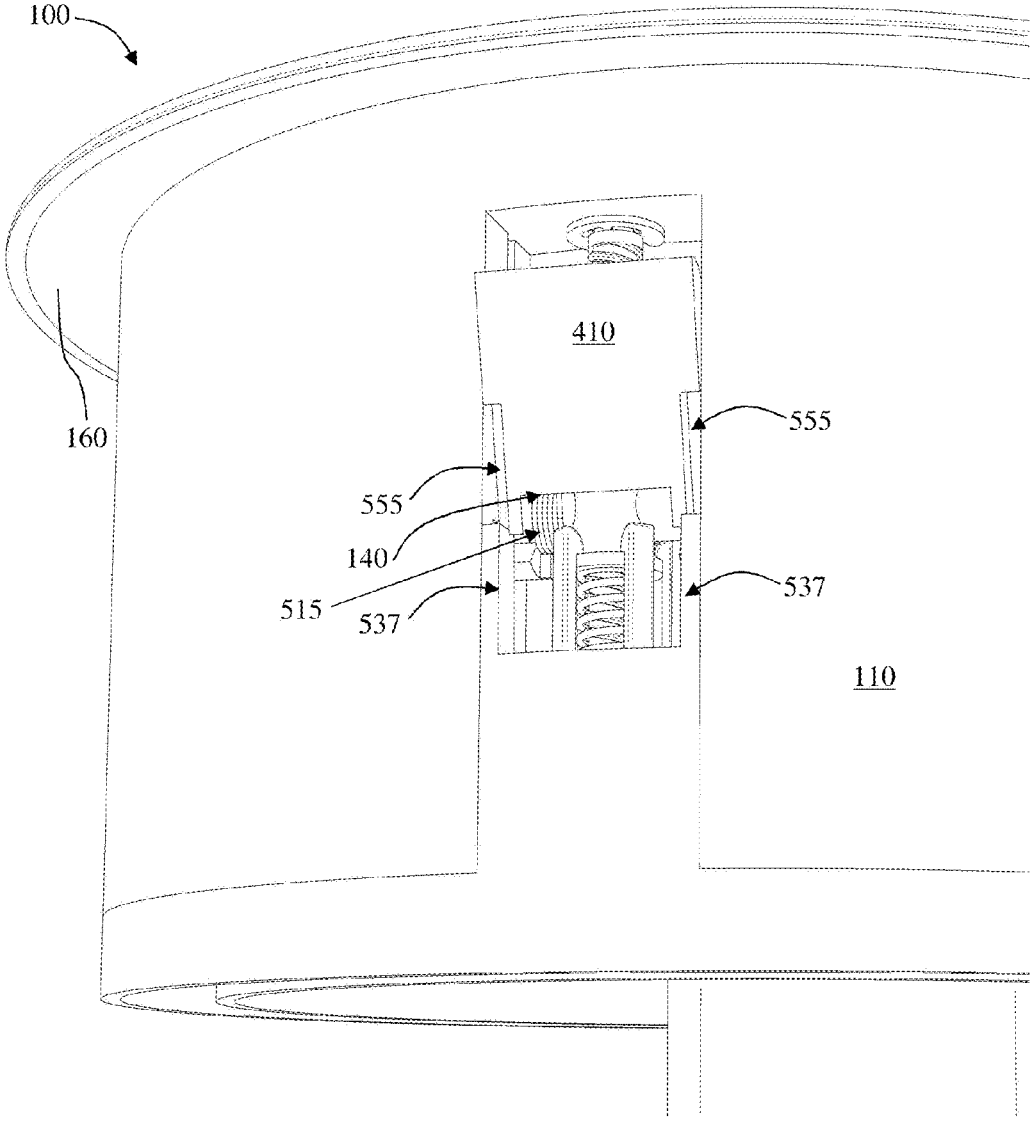
FIG. 4 illustrates an enlarged elevation view of the latching mechanism of the speaker assembly of FIG. 1.

Referring to FIGS. 2 and 4, the latching mechanism 140 may include a plurality of components according to various embodiments. FIG. 4, in particular, illustrates an enlarged elevation view of the latching mechanism 140 of the speaker assembly 100 of FIG. 1. The latching mechanism 140 includes a latch 410 (see also FIG. 10) configured to pivot inward (in a retracted position) for installing and removing the speaker assembly 100, and to pivot outward (to an extended position) for securing the speaker assembly 100 in place in a recess.

Figure 5:
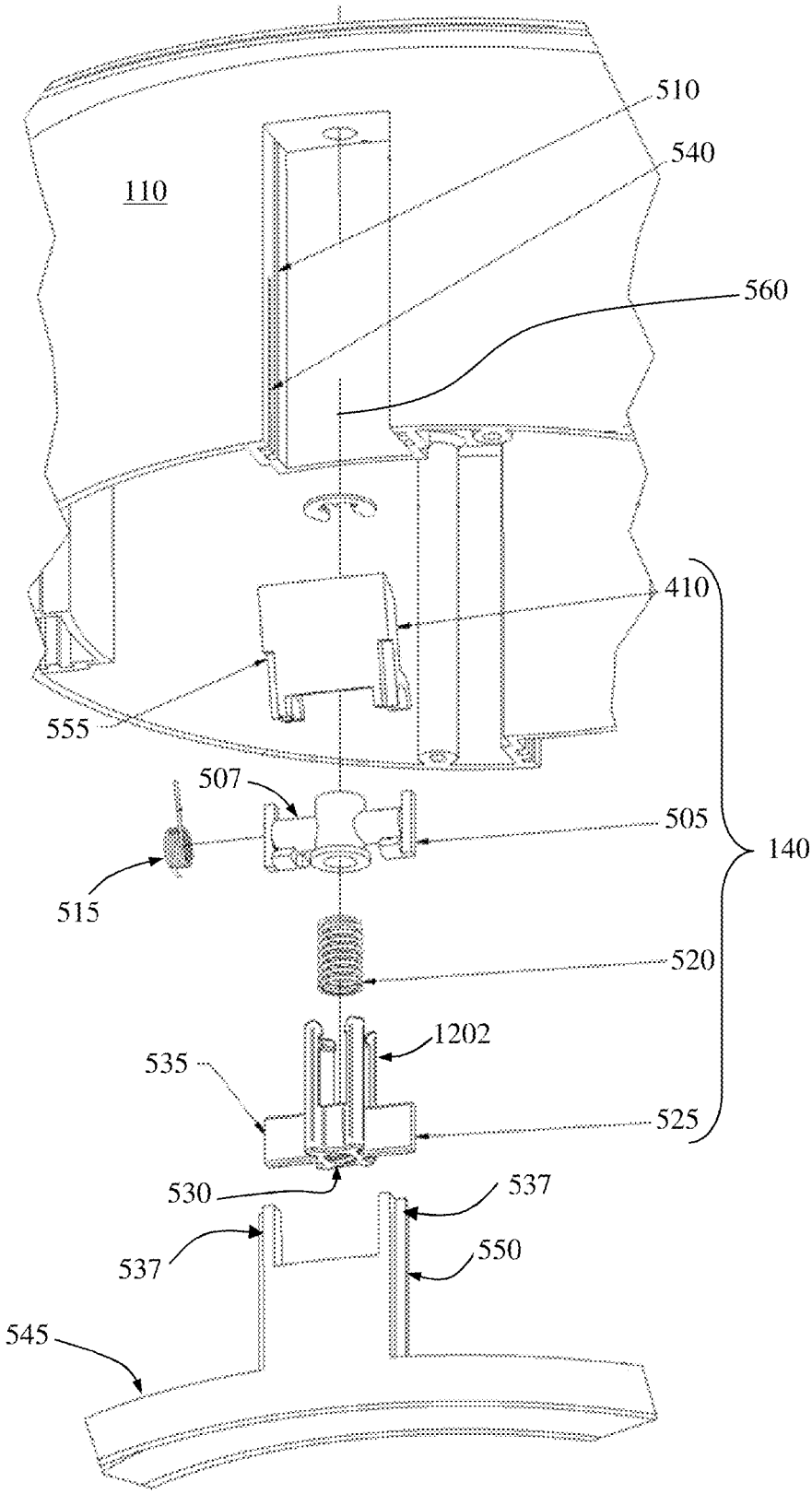
FIG. 5 illustrates an exploded view of the various latch assembly components according to at least one embodiment.

FIG. 5 shows an exploded view of various components of a latching mechanism 140 according to at least one embodiment of the present disclosure. The latching mechanism 140 (see also FIG. 8) includes a latch 410 hingedly coupled to a latch slide 505. The latch slide 505 (see also FIG. 11) is configured to slidably receive a screw 210 therethrough (See FIG. 2). The latch slide 505 engages a pair of latch slide slots 510 disposed into the frame 110 to inhibit rotation of the latch slide 505 when the screw 210 is rotated. In some embodiments, the latch 410 is configured to snap onto the latch slide 505 via a pair of semi-circular, mating latch axles 507 that allow the latch 410 a fixed amount of rotational movement around the latch axle 507. The rotational movement of the latch may be constrained by a pair latch axle stops.

In order to ensure that the latch 410 pivots outward from the frame 110 when the latch 410 is deployed, a latch pivot bias spring 515 may be employed and disposed to exert a force against the latch 410 sufficient to cause the latch 410 to pivot outward. The latch pivot bias spring 515 may comprise any conventional spring that biases the latch 410 outward (i.e., in the extend position). In typical operation, the bias spring 515 keeps the latch 410 extended outward. Turning of the screw 210 serves to move the latching mechanism 140 up or down. As the latching mechanism 140 moves down (away from the rim 160), latch retraction slides 555 at the sides of the latch 410 are acted upon by retraction guides 537 on either side the extension 550. That is, as the latch 410 moves down, the latch retraction slides 555 come into contact with the retraction guides 537, causing the latch 410 to rotate inward (i.e., retract). In the opposite direction, as the latch 410 moves up, the latch retraction slides 555 disengage from the retraction guides 537, causing the latch 410 to rotate outward (i.e., extend out) due to the biasing from the latch pivot bias spring 515.

A compression spring 520 may also be employed within securing arms 1202 (FIG. 12) of a latch nut 525, where the compression spring 520 pushes on the latch slide 505 while the securing arms 1202 limit how far the latch slide 505 is able to move from the latch nut 525. The compression spring 520 pushes on the latch slide 505 and exerts a force to bias the latch slide 505 upward (as oriented in FIG. 5) along the screw 210 (not shown) disposed through the latch slide 505.

A latch nut 525 (see also FIGS. 12 and 13) is configured to be coupled to the latch slide 505 and to receive at least a portion of the compression spring 520 within the securing arms 1202. The latch nut 525 includes an aperture 530 configured to receive a screw 210. The aperture 530 may include threads configured to receive the threads 320 of the screw 210. Accordingly, as the screw 210 is rotated, the threaded connection between the screw 210 and the latch nut 525 causes the latch nut 525 to move up or down (as oriented in FIG. 5) along a rotational axis 560 of the screw 210. Because the latch nut 525 is coupled with the latch slide 505 and the latch 410, rotation of the screw 210 causes the entire latching mechanism to move upward and downward. Note that the use of the terms up and down, or upward and downward refers to the direction as oriented in the accompanying drawing figures. In order to inhibit rotation of the latch nut 525 upon rotation of the screw 210, the latch nut 525 may include counter-rotation flanges 535 that are configured to engage latch nut slide slots 540 formed in the frame 110.

A latch retaining ring 545 may also be employed, which is configured to aid in retracting the latches 410. As illustrated in FIG. 5, the latch retaining ring 545 includes an extension 550 associated with each latching mechanism 140. Furthermore, the latch 410 may include one or more latch retraction slides 555. The latch retraction slides 555 are configured to engage a portion of the extensions 550 of the latch retaining ring 545, causing the latch 545 to pivot inward to a retracted position when the latching mechanism is displaced downward.

Although the latching mechanism 140 is illustrated in FIG. 5 with particular components, a person of ordinary skill in the art will recognize that at least some of the components may be modified, combined or discarded according to various embodiments of a latching mechanism 140 of the present disclosure. Thus, the latching mechanism 140 may include additional, fewer or different components in various embodiments.

Figure 6:
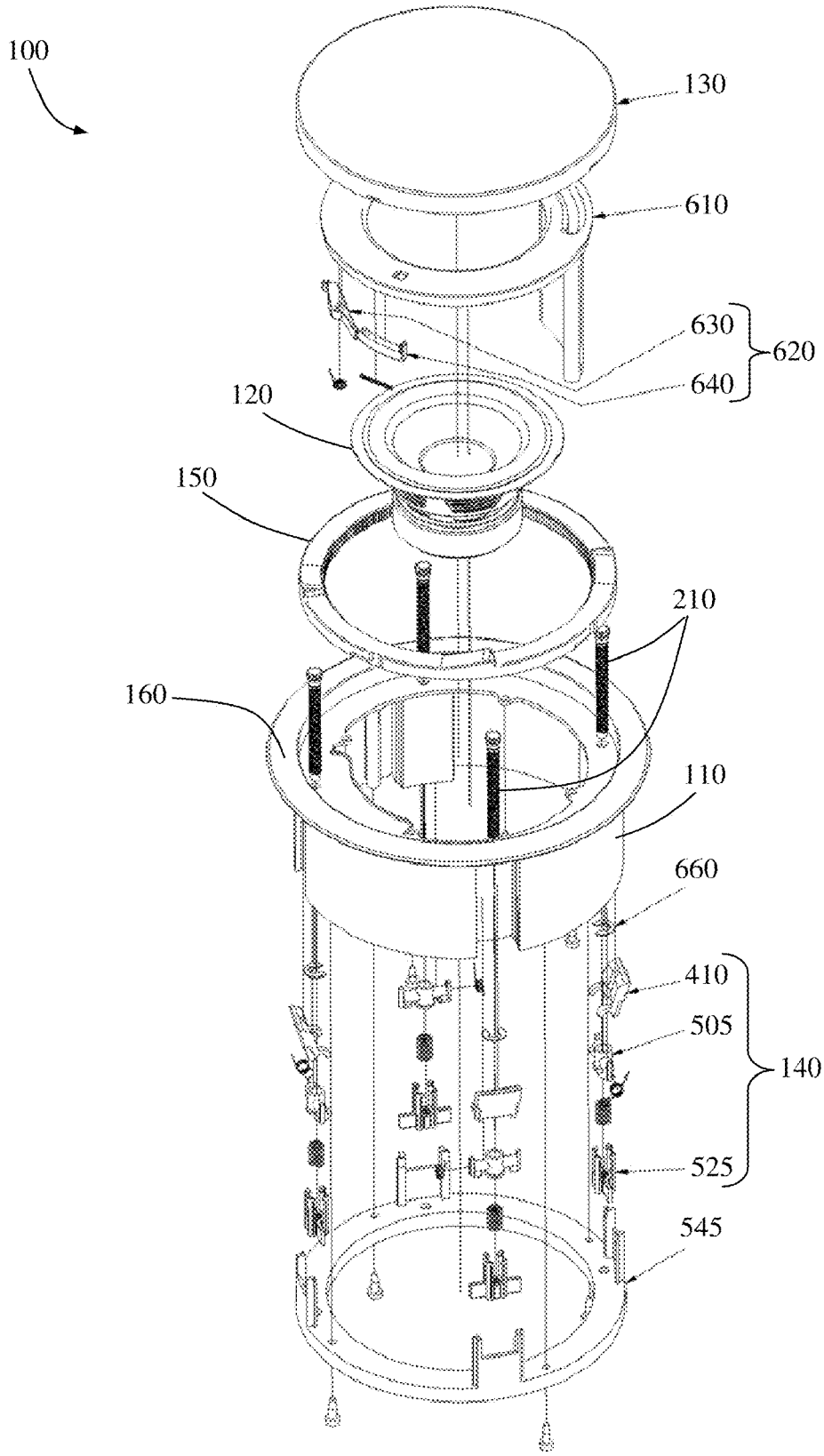
FIGS. 6 and 7 illustrate exploded views of a speaker assembly according to one example.
Figure 7:
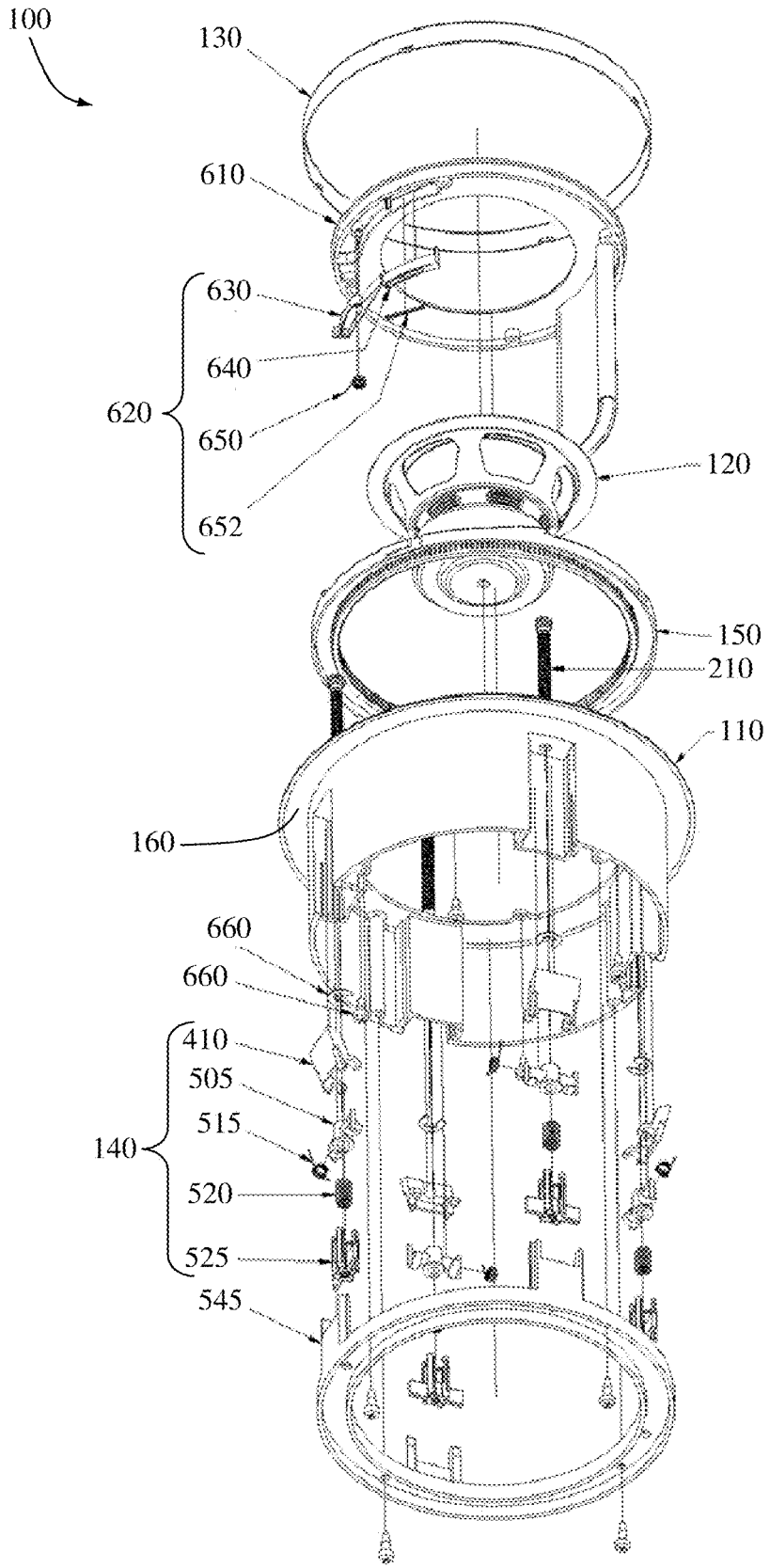

In at least some embodiments of a speaker assembly 100 of the present disclosure, an anti-rotation gear ring ratchet 620 may be employed as illustrated in FIGS. 6 and 7. The anti-rotation gear ring ratchet 620 may be configured to engage an anti-rotation ring gear 350 (shown in FIG. 3) of the gear ring 150 to inhibit rotation of the gear ring 150.

Some embodiments of the present disclosure include methods for installing a speaker assembly. Referring to FIGS. 1-5, the various components described above combine such that, as the frame 110 is inserted through a mounting hole in a mounting panel (e.g., a wall, ceiling, sheet, etc.), the latches 410 are configured to move out of the way of the hole until such time that they clear the back-side surface of the panel. According to at least one embodiment of such a method for installing the speaker assembly 100, the frame 110 may be inserted through the mounting hole in the panel. The gear ring 150 may be rotated to cause the plurality of screws to rotate. The latches 410 are extended outward to engage the back-side surface of the panel. The latches 410 may be extended outward by rotating the screws 210 in a direction to cause the latching mechanisms 140 to displace upward, causing the latches 410 to extend outward from the frame 110.

In some embodiments, for example in embodiments employing a latch pivot spring, the latches 410 may be adjusted to their extended position prior to inserting the frame 110 through the mounting hole. In such embodiments, the latches 410 are pivoted inward against the latch pivot bias spring 515 by the panel when passing through the mounting hole, and then the latches 410 are forced by the latch pivot bias spring 515 to pivot outward to an extended position when the latches 410 clear the back-side surface of the panel. Such installation may be particularly beneficial for speaker assemblies 100 installed overhead, since the assembly is at least passively secured from falling as soon as the latches 410 clear the back-side surface of the panel. Additional adjustments to more fully secure the speaker assembly 100 may then be made by the installer as described herein below.

In other embodiments, the latches 410 may be retracted prior to placing the frame through the mounting hole. The latches 410 may be retracted by rotating the gear ring 150 to cause the screws 210 to rotate in a direction to displace the latching mechanisms 140 downward (e.g., by the retracting guides 537 acting on the latch retraction slides 555). As the latching mechanisms 140 are displaced downward, the latches 410 may pivot inward to a retracted position. The frame 110 may then be positioned through the mounting hole and the latches 410 extended outward by rotating the gear ring 150 (in an opposite direction) to cause the screws 210 to rotate in an opposing direction to displace the latching mechanisms 140 upward (i.e., toward the rim 160). As the latching mechanisms 140 are displaced upward, the latches 410 may pivot outward to an extended position (e.g., the latch retraction slides 555 disengage from the retracting guides 537 and the bias spring 515 acting on the latch 410).

After the latches 410 are pivoted outward to the extended position to retain the frame 110 within the mounting hole, the gear ring 150 and screws 210 may be further rotated to further move the latching mechanisms 140 toward the back-side surface of the panel to increase latch pressure against the back-side surface of the panel and to compensate for any variations in panel thickness. Furthermore, the compression springs 520 of each latching mechanism 140 enable the latching mechanisms 140 to accommodate for tolerance variations between latching mechanisms 140 by allowing the latches 410 to compress the compression spring 520 until all latches 410 are in sufficient contact with a sufficient pressure against the back-side surface of the panel.

Because the latches 410 are pivoted between the retracted and extended positions and displaced upward or downward by the simple rotation of the gear ring 150, embodiments of a speaker assembly 100 of the present disclosure may be installed with the use of only the installer's hands to rotate the gear ring and without the need of any additional installation tools.

In embodiments employing an anti-rotation gear ring ratchet 620 (shown in FIGS. 6, 7, 9, 15-20), the gear ring 150 may be locked in place with the latches 410 positioned in contact with and at a sufficient pressure against the back-side surface of the panel. Accordingly, the contact of the latches 410 will not be released by unintended rotation of the gear ring 150 after the speaker assembly 100 is installed.

In order to remove an installed speaker assembly 100, the anti-rotation gear ring ratchet 620 may be disengaged from the gear ring 150, and the gear ring 150 may be rotated to release latch pressure against the panel and retract the latches 410 by displacing the latches 410 downward. Upon continued rotation of the gear ring 150, the latch retraction slide 555 of each latch 410 eventually encounters the latch retaining ring 545. As the gear ring 150 rotation is continued, the latch 410 is forced into a vertical position, thereby allowing the assembly to be dismounted or removed from the mounting hole in the panel. The speaker assembly 100 may be removed and reinstalled numerous times.

Additional embodiments of the present disclosure include methods of making a speaker assembly 100. Referring to FIGS. 6 and 7, at least one embodiment of such methods may include coupling a plurality of screws 210 with a gear ring 150 to enable rotation of the plurality of screws 210 in response to rotation of the gear ring 150. A latching mechanism 140 is coupled to each of the plurality of screws 210 in a manner adapted to displace each latching mechanism 140 along a rotational axis of the respective screw 210 when the plurality of screws 210 are rotated.

Coupling the plurality of screws 210 with the gear ring 150 may include mating the screw gear portion 310 (shown in FIG. 3) of each screw 210 to the ring gear portion 330 (shown in FIG. 3) of the gear ring 150. By mating the screw gear portion 310 to the ring gear portion 330, the screws 210 may be rotated by rotating the gear ring 150.

Coupling a latching mechanism 140 to each of the plurality of screws 210 may include forming the latching mechanism 140 including a latch 410 rotatably coupled to a latch slide 505, a latch pivot spring disposed between the latch 410 and the latch slide 505, a latch nut 525 coupled to the latch slide 505, and a compression spring 520 disposed between the latch slide 505 and the latch nut 525. The latch nut 525 is then coupled to a screw 210 by receiving the threads of the screw 210 with corresponding threads on the latch nut 525.

In addition, a method of making a speaker assembly may further include coupling the plurality of screws 210 and the gear ring 150 to a frame 110. An audio transducer 120 may be coupled to a baffle 610, and the audio transducer 120 and baffle 610 may be disposed at least partially within the frame 110. A grille 130 may coupled to the frame 110 and disposed over the baffle 610, the audio transducer 120 and the gear ring 150.

An anti-rotation gear ring ratchet 620 may be coupled with the baffle 610 and configured to prevent the counter-rotation of the gear ring 150 until such time that the anti-rotation gear ring ratchet 620 is released. The anti-rotation gear ring ratchet 620 may be formed to include a ratchet latch 630 and a ratchet latch release lever 640, with a ratchet latch bias spring 650 and ratchet latch release lever bias spring 652. The anti-rotation gear ring ratchet 620 may be configured to engage an anti-rotation ring gear 350 (shown in FIG. 3) of the gear ring 150 to inhibit the rotation thereof.

Additionally, a plurality of conventional fasteners 660, such as screws, clips and other fasteners may be employed to couple various components of the speaker assembly together.

Figure 8:
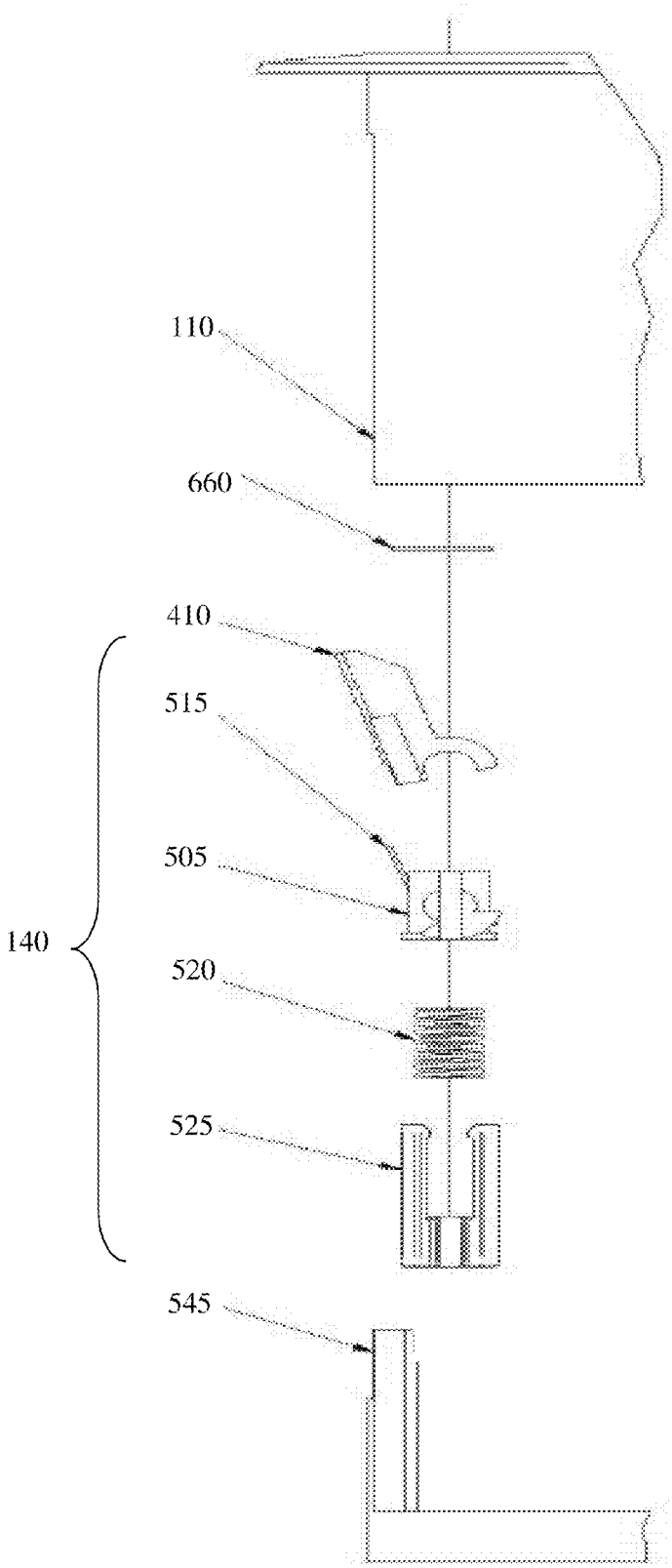
FIG. 8 illustrates a side view of various components of the latching mechanism 140 according to at least one embodiment of the present disclosure.

FIG. 8 illustrates a side view of various components of the latching mechanism 140 according to at least one embodiment of the present disclosure. Note that the screw 210 passes through the latching mechanism 140 (e.g., through the latch slide 505, compression spring 520, and latch nut 520) to engage and cause the extending and/or retraction of the latch 410 upon rotation of the screw 210.

Figure 9:
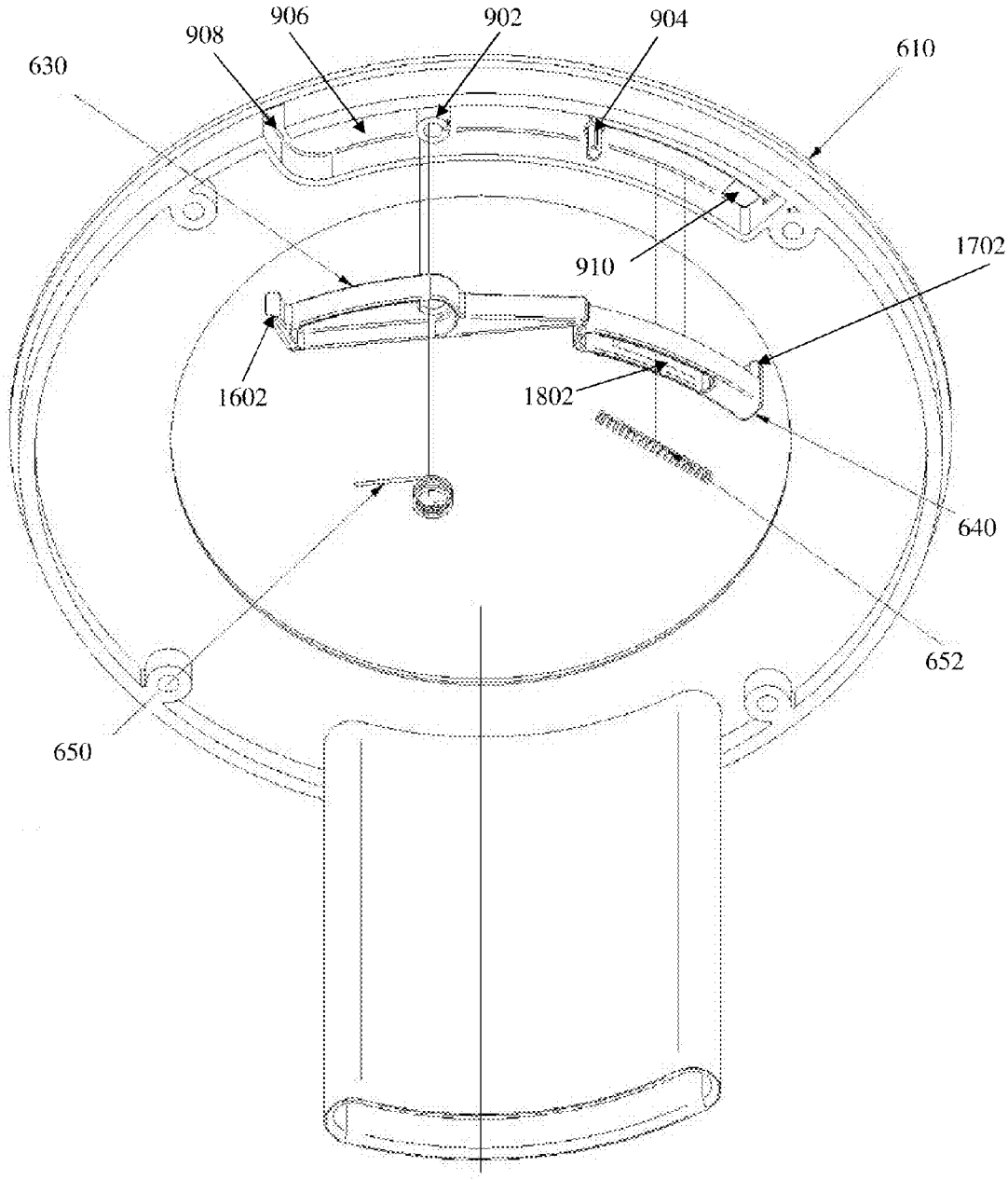
FIG. 9 illustrates the baffle and the ratchet mechanism according to one embodiment.

FIG. 9 illustrates the baffle 610 and the ratchet mechanism according to one embodiment. The ratchet mechanism includes the ratchet latch 630, the ratchet latch release lever 640, the ratchet latch bias spring 650, and the release lever bias spring 652. The ratchet mechanism may be housed within a cavity 906 along one side of the baffle 610. The ratchet latch 630 pivots about a first pin 902. The ratchet latch bias spring 650 also passes through the first pin 902 and biases the ratchet latch 630 so that an engagement latch portion 1602 extends through a vertical groove 908 on the side of the baffle 610 and engages the anti-rotation ring gear 350 (shown in FIG. 3) of the gear ring 150 to inhibit rotation of the gear ring 150. This way, once the gear ring 150 has been rotated to extend the one or more latches 410 outward, the gear ring 150 can be inhibited from rotating back by the engagement latch portion 1602 acting on the anti-rotation ring gear 350. Note that the anti-rotation ring gear 350 and engagement latch portion 1602 may be configured to allow the gear ring 150 to be rotated in one direction (e.g., a first direction that extends the one or more latches 410 outward) but prevents the rotation of the gear ring 150 in the opposite (reverse) direction.

The release lever 640 is also housed within the cavity 906 and a push lever 1702 (FIG. 17) passes through an opening 910 in the baffle 610. A release lever bias spring 652 is housed within a cavity 1802 (FIG. 18) of the release lever 604. A first end of the spring 652 pushes against a pin 904 while a second end of the spring 652 pushes against an opposite inner wall of the cavity 1802 so as to bias the release lever 640 away from the ratchet latch 630. Note that the pin 904 passes through a pass-through opening 1804 (FIG. 18) in the cavity 1802. When installed, the push lever 1702 passes to the outer face of the speaker assembly 100. Thus, the push lever 1702 may be pushed to slide along the opening 910 so that an actuating end 1704 (FIG. 17) of the release lever 640 pushes against an actuating arm 1606 (FIG. 16) of the ratchet latch 630 and causes the engagement latch portion 1602 to be retracted and disengage the anti-rotation ring gear 350. This retraction of the engagement latch portion 1602 allows the gear ring 150 to be rotated (in a reverse direction) to cause the one or more latches 410 to retract inward. Upon release of the push lever 1702 causes the lever release bias spring 652 to push the release lever 640 back and the ratchet latch bias spring 650 causes the ratchet latch 630 to again engage the anti-rotation ring gear 350.

Figure 10:
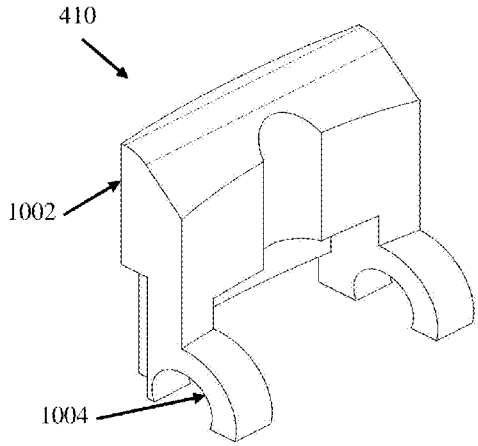
FIG. 10 illustrates a view of the latch according to one example.

FIG. 10 illustrates a view of the latch 410 according to one example. The latch 410 may include a securing portion 1002 and pivoting clamps 1004 which engage the mating latch axles 507 on the latch slide 505. Thus, the pivoting clamps 1004 rotate or pivot about the latch axles 507 as the latch 410 extends outwards or retracts inwards.

Figure 11:
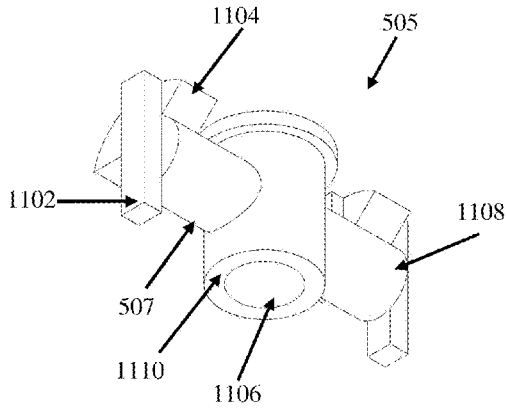
FIG. 11 illustrates a view of the latch slide according to one example.

FIG. 11 illustrates a view of the latch slide 505 according to one example. The latch slide may include a central body 1110 defining a passage 1106 for the screw 210, side arms 1108 defining latch axles 507 and rotation stoppers 1104. The rotation stoppers 1104 may stop the rotation of the latch 410 by engaging the pivoting clamps. The ends of the side arms 1108 may also include slides 1102 that serve to slide within the latch slide slots 510 (FIG. 5).

Figure 12:
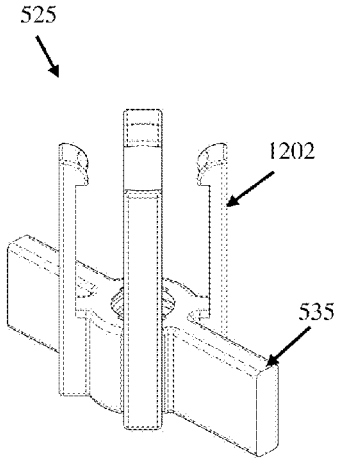
FIGS. 12-13 illustrate two views of the latch nut according to one example.
Figure 13:
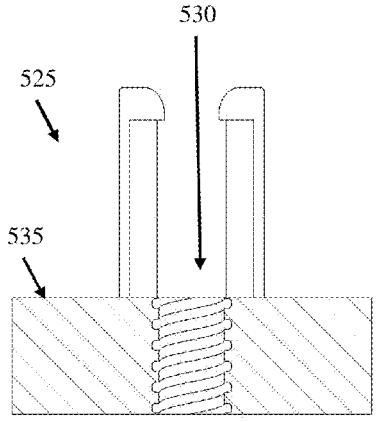

FIGS. 12-13 illustrate two views of the latch nut 525 according to one example. The latch nut 525 may include securing arm 1202 that are arranged axially around the aperture 630 in the direction of the screw 210. The securing arms 1102 serve to hold the compression spring 520 therein. The aperture 530 may be internally threaded to receive the threads 320 of the screw 210, allowing the latch nut 525 to move up or down depending on the rotation of the screw 210. The upward or downward movement of the latch nut 525 causes the outward extension or inward retraction, respectively, of the latch 410. The counter rotation flanges 535 serve to slide within the latch nut slide slots 540.

Figure 14:
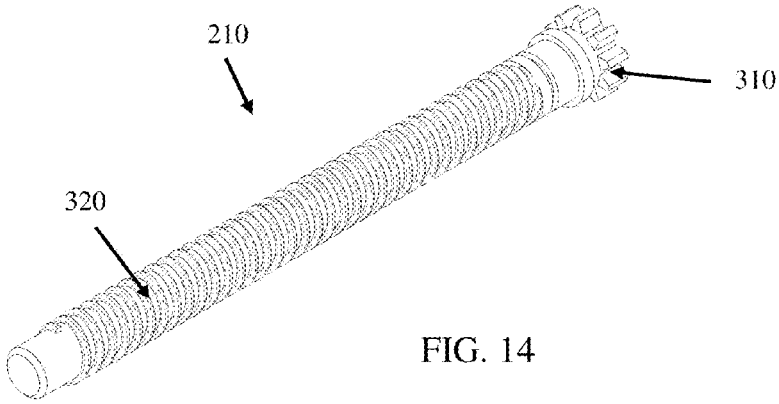
FIG. 14 illustrates a view of the screw according to one example.

FIG. 14 illustrates a view of the screw 210 according to one example.

Figure 15:
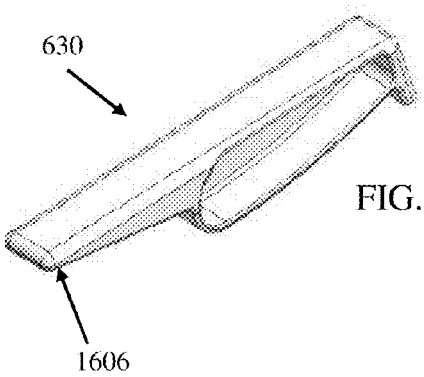
FIGS. 15-16 illustrate views of the ratchet latch according to one example.
Figure 16:
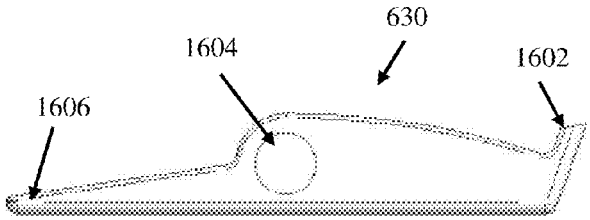

FIGS. 15-16 illustrate views of the ratchet latch 630 according to one example. The latch 630 may include the actuating arm 1606, the engagement latch portion 1602, and an opening 1604 through which the first pin 902 passes to allow pivoting of the ratchet latch 630.

Figure 17:
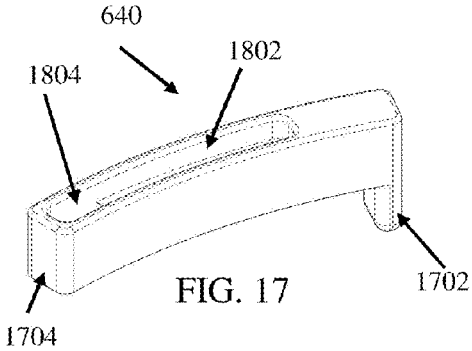
FIGS. 17-18 illustrate views of the release lever according to one example.
Figure 18:
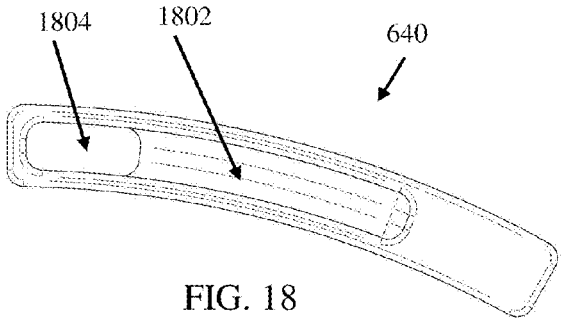

FIGS. 17-18 illustrate views of the release lever 640 according to one example.

Figure 19:
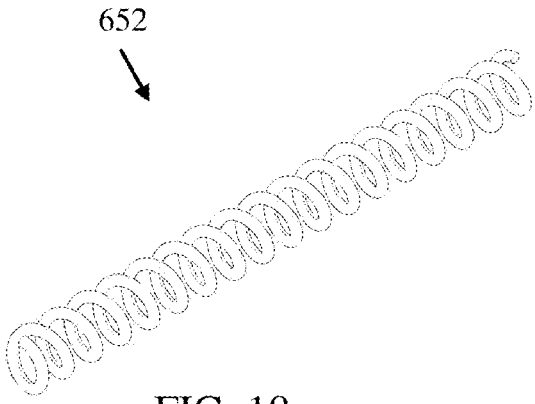
FIG. 19 illustrates a view of the release lever bias spring according to one example.

FIG. 19 illustrates a view of the release lever bias spring 652 according to one example.

Figure 20:
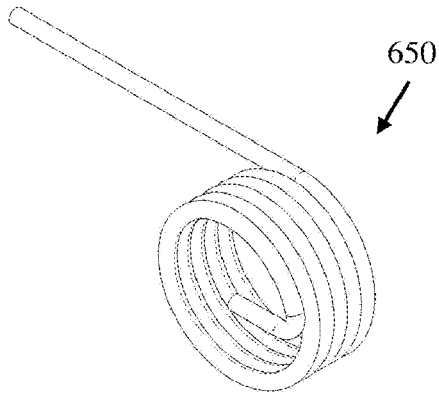
FIG. 20 illustrates a view of the ratchet latch bias spring according to one example.

FIG. 20 illustrates a view of the ratchet latch bias spring 650 according to one example.

Figure 21:
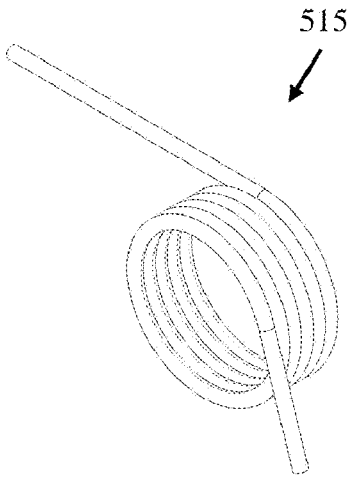
FIG. 21 illustrates a view of the latch pivot spring according to one example.

FIG. 21 illustrates a view of the latch pivot bias spring 515 according to one example.

Figure 22:
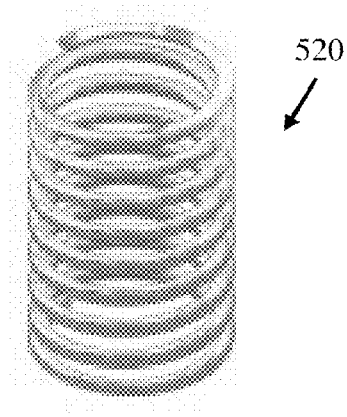
FIG. 22 illustrates a view of the compression spring according to one example.

FIG. 22 illustrates a view of the compression spring 520 according to one example.

The various embodiments of the present disclosure result in speaker assemblies that are capable of: being installed without any need for indexing; being installed into or through a pre-cut hole with a single linear motion; being passively captured by a panel after the latches have cleared the backside thereof to prevent accidental dismounting when installed overhead; being seated against the panel with a simple human hand; actuating all latches simultaneously; accommodating a wide variation in panel thickness; accommodating variations in panel thickness from latch to latch; compensating for its own tolerance variations making it less costly to manufacture; being scaled to accommodate large ranges of loads; being locked to prevent loss of latch pressure against the panel; and providing for simple, no-tool dismounting, as well as other benefits. Such speaker assemblies may be utilized in almost any device that requires mounting into some kind of a flat panel, sheet, or cavity.

While certain exemplary embodiments have been described and shown in the accompanying drawings, it is to be understood that such embodiments are merely illustrative of and not restrictive on the broad disclosure, and that this disclosure not be limited to the specific constructions and arrangements shown and described, since various other additions and modification to, and deletions from, the described embodiments will be apparent to one of ordinary skill in the art. Thus, the scope of the disclosure is only limited by the literal language, and legal equivalents, of the claims which follow.

What is claimed is:

1. A speaker assembly, comprising:

a gear ring;

a plurality of screws adapted to rotate when the gear ring is rotated; and a latching mechanism adapted to extend one or more latches outward as the gear ring is rotated a latch slide configured to slidably receive a screw of the plurality of screws; a latch hingedly coupled to the latch slide, the latch configured to extend outward or to retract inward; a latch nut coupled to the latch slide, the latch nut including an aperture having threads configured to receive therein threads of the screw; and a compression spring disposed between the latch nut and the latch slide.

2. The speaker assembly of claim 1, wherein the gear ring is adapted to be manually rotated.

3. The speaker assembly of claim 1, wherein each screw of the plurality of screws includes a screw gear portion matingly coupled to a ring gear portion of the gear ring.

4. The speaker assembly of claim 1, wherein the latching mechanism is displaced along the rotational axis of a screw as the gear ring is rotated.

5. The speaker assembly of claim 1, wherein the latching mechanism includes:

a latch slide configured to slidably receive a screw of the plurality of screws;

a latch hingedly coupled to the latch slide, the latch configured to extend outward or to retract inward;

a latch nut coupled to the latch slide, the latch nut including an aperture having threads configured to receive therein threads of the screw; and a compression spring disposed between the latch nut and the latch slide.

6. The speaker assembly of claim 1, further comprising an anti-rotation gear ring ratchet adapted to inhibit rotation of the gear ring when engaged and further adapted to be manually disengaged.

7. The speaker assembly of claim 1, further comprising:

a frame; and an audio transducer housed within the frame.

8. A fastening mechanism for a speaker assembly, comprising:

means for coupling a plurality of screws with a gear ring to enable rotation of the plurality of screws when the gear ring is manually rotated; and means for coupling a latching mechanism to each of the plurality of screws, each latching mechanism configured to displace along a rotational axis of the respective screw when the plurality of screws are rotated a latch rotatably coupled to a latch slide; a latch pivot spring disposed between the latch and the latch slide; a latch nut coupled to the latch slide; and a compression spring disposed between the latch slide and the latch nut.

9. The fastening mechanism of claim 8, wherein coupling the plurality of screws with the gear ring to enable rotation of the plurality of screws when the gear ring rotates comprises mating a screw gear portion of each of the plurality of screws to a ring gear portion of the gear ring.

10. The fastening mechanism of claim 8, wherein coupling the latching mechanism to each of the plurality of screws includes coupling a latch nut comprising a threaded aperture to threads of a screw of the plurality of screws.

11. The fastening mechanism of claim 8, wherein the latching mechanism comprises:

a latch rotatably coupled to a latch slide;

a latch pivot spring disposed between the latch and the latch slide;

a latch nut coupled to the latch slide; and a compression spring disposed between the latch slide and the latch nut.

12. The fastening mechanism of claim 8, further comprising:

means for coupling the plurality of screws and the gear ring to a frame; and means for disposing an audio transducer within a portion of the frame.

13. The fastening mechanism of claim 8, further comprising:

means for disposing an anti-rotation gear ring ratchet to engage an anti-rotation ring gear of the gear ring.

* * * * *